United States Patent [19]

Hall

[11] 4,153,197

[45] May 8, 1979

[54] COIN BANK

[76] Inventor: A. Douglass Hall, David's Hill Rd., Bedford Hills, N.Y. 10507

[21] Appl. No.: 832,459

[22] Filed: Sep. 12, 1977

[51] Int. Cl.[2] ..... A47G 29/00

[52] U.S. Cl. ..... 232/5; 133/1 A

[58] Field of Search ..... 133/1 A, 8 A; 206/.82, 206/.83, .84; 232/4, 5, 6

[56] References Cited

U.S. PATENT DOCUMENTS

| | | | |
|---|---|---|---|
| 1,457,261 | 5/1923 | Mathewes | 133/1 A X |
| 2,421,577 | 6/1947 | Pirrung | 232/4 R |
| 2,441,486 | 5/1948 | Hagopian | 133/1 A |
| 2,563,291 | 8/1951 | Thompson | 232/5 |
| 2,802,325 | 8/1957 | Capodanno | 53/254 |
| 2,808,199 | 10/1957 | Rappeport | 232/5 |
| 3,120,235 | 2/1964 | Ferrell | 133/1 A X |
| 3,229,700 | 1/1966 | Bell | 232/5 X |
| 3,242,931 | 3/1966 | Wandrey | 232/5 X |
| 3,882,659 | 5/1975 | Charlop | 133/1 A X |

*Primary Examiner*—Roy D. Frazier
*Assistant Examiner*—Peter A. Aschenbrenner
*Attorney, Agent, or Firm*—Pennie & Edmonds

[57] ABSTRACT

A coin bank having a plurality of tubular members upstanding from a base, each tubular member having a predetermined cross-sectional area sufficient to receive coins of a particular denomination. The effective height of each tubular member is such that when filled with coins the number contained therein will fill a standard coin wrapper. There is a space of predetermined thickness between the stack of coins and the inner wall of the tubular member sufficient to permit the insertion of the coin wrapper into the tubular member and around the coins stored therein.

9 Claims, 6 Drawing Figures

FIG. 1
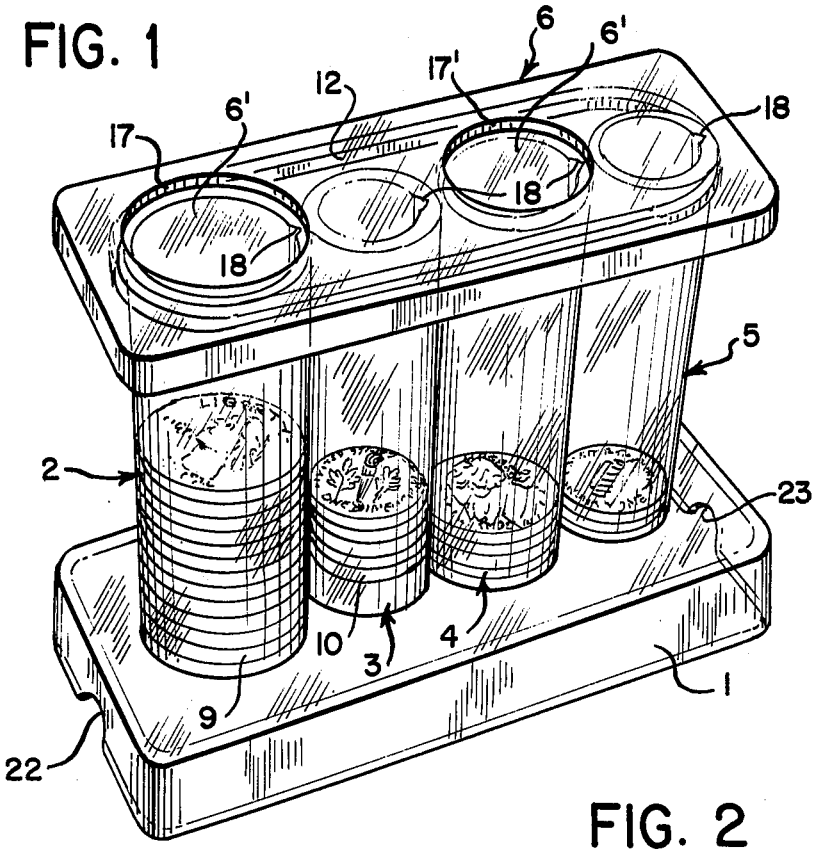
FIG. 2
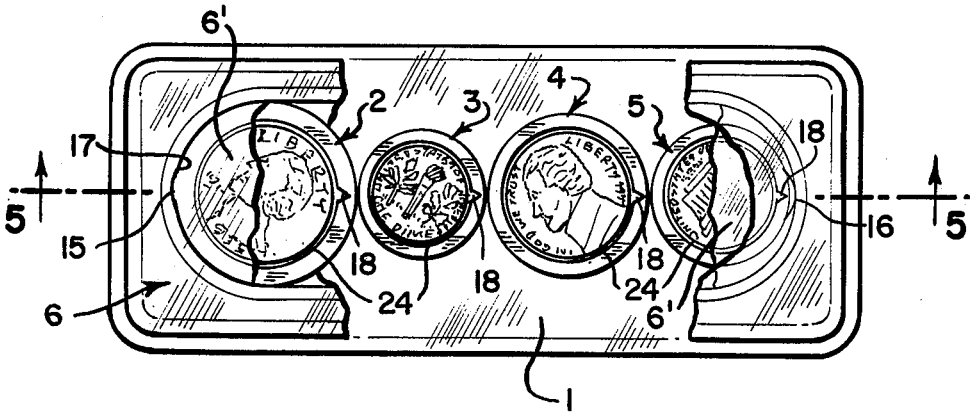
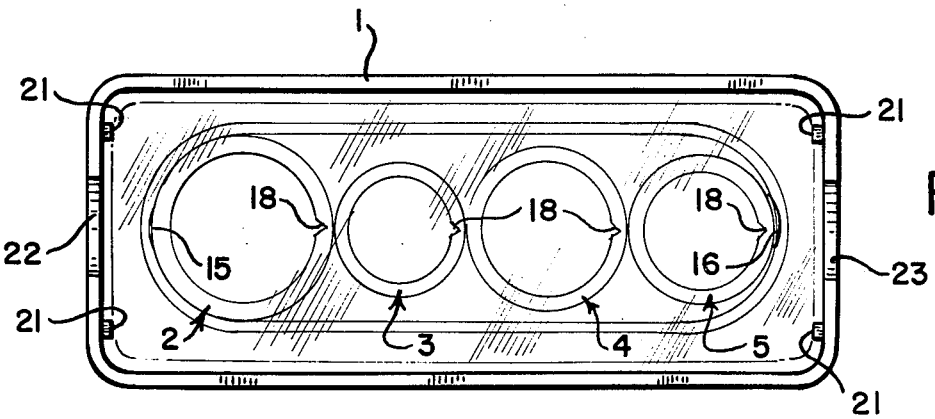
FIG. 3

COIN BANK

BACKGROUND OF THE INVENTION

Banks capable of storing coins in stacked relationship are known in the prior art. Such banks have been provided with means for facilitating the transfer of the stored coins to a coin wrapper. For example, movable sleeves have been positioned at the mouth portions of such banks to engage the open end of a coin wrapper. Such a construction, however, does not satisfy two main requirements of coin handling devices of this type which are ease of manufacture and simplicity of operation.

SUMMARY OF THE INVENTION

Coin banks of the type described herein where the configuration of the storage tube itself facilitates the transfer of coins are easily formed from a variety of inexpensive materials, do not require skilled personnel for assembly, and will remain operational indefinitely due to the inherent durability of the device.

In construction, the coin bank of the present invention includes a base with a plurality of generally tubular walled members upstanding from one side thereof. Each tubular member has an inner wall defining a cross-sectional area of predetermined size configured to receive coins having a preselected lesser cross-sectional area. Each tubular member has an effective height equal to the height of a stacked plurality of coins sufficient to fill a standard coin wrapper suited for the particular denomination of stacked coins. Each of the tubular members has a clearance space defined by the inner wall of the tubular member and the circumference of the stack of coins stored therein, said clearance space being of sufficient thickness to permit the placing of the wrapper into the tubular member and around the stack of coins stored therein.

In the preferred embodiment the tubular members are arranged in side by side linear relationship in a manner to minimize the inadvertent placing of a coin of the wrong denomination in a particular tubular member. Where a transparent material such as glass or plastic is used to construct the coin bank, markings may be placed on the tubular members to indicate the amount stored therein at any given time. The bottom members of each tubular member are so positioned that the actual height of each tubular member is the same while the effective height varies according to the corresponding denomination of coins to be placed therein. This permits the use of a single plate-like cover for all of the tubular members. The cover is provided with two substantially circular openings positioned to permit the insertion of a coin wrapper into either an outermost tubular member and around the coins stored therein or into a nonadjacent inner tubular member and around the coins stored therein when the cover is in place. The openings may be covered when not in use by means of a closure plate which is held in the cover recess by frictional engagement with the inner wall of the depending skirt. A convenient storage recess for the cover is provided in the base of the subject bank when the cover is not in use. The cover is held in the recess by frictional contact with engagement surfaces positioned within the recess.

DESCRIPTION OF THE DRAWINGS

FIG. 1 is a perspective view of the coin bank constructed according to the invention.

FIG. 2 is a top view of the coin bank with a portion of the top cut away showing coins in stacked relationship within the tube members.

FIG. 3 is a bottom view of the coin bank.

DETAILED DESCRIPTION OF THE PREFERRED EMBODIMENT

Figure 4:
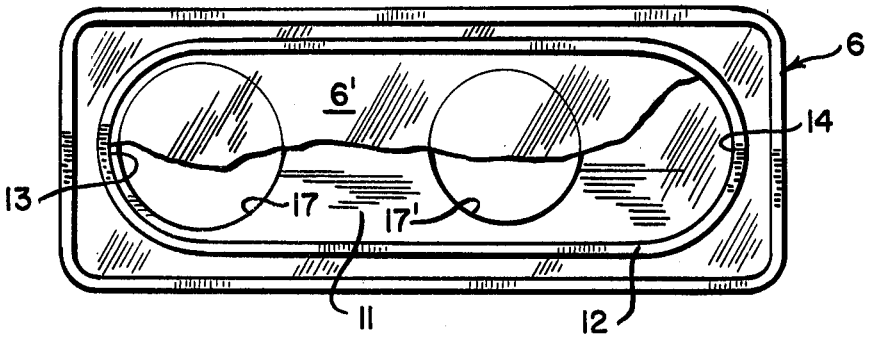
FIG. 4 is a bottom view of the coin bank cover.

The coin bank as shown in FIG. 1 has a base 1 with the tubular members 2, 3, 4, and 5 for containing coins upstanding from one side thereof. The tubular members 2, 3, 4, and 5 define a substantially circular cross-sectional area with each tubular member being configured to receive coins of different denominations. As shown in FIG. 2, tubular member 2 is dimensioned to receive quarters, tubular member 3 only accepts dimes, tubular member 4 is configured to receive nickles and tubular member 5 is provided for the storage of pennies. This preferred positioning of tubular members 2, 3, 4 and 5 is such that error in coin placement is minimized.

Figure 5:
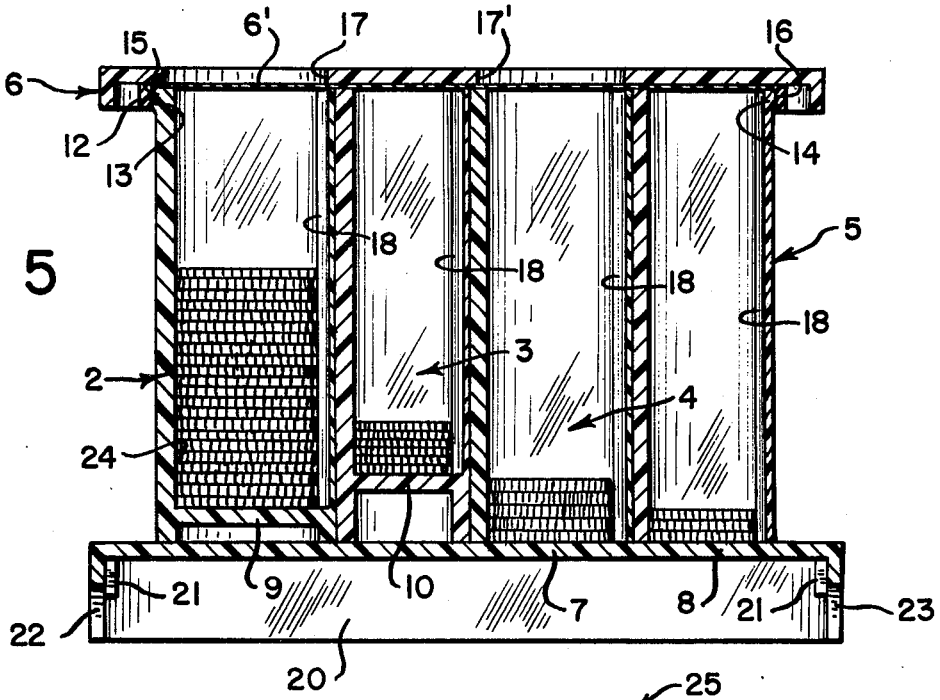
FIG. 5 is a sectional view of FIG. 2 taken along lines 5—5.

Each tubular member has a closed bottom. As shown in FIG. 5 the bottom members 7 and 8 for tubular members 4 and 5 are comprised of the base member itself while the bottom members 9 and 10 of tubular members 2 and 3 respectively are disks having a diameter equal to that of the tubular member in which they are securely positioned. Bottom members 7, 8, 9, and 10 control the effective height of tubular members 2, 3, 4, and 5. The positioning is such that when a given tubular member is filled with coins configured to be received therein, the number of said coins is just sufficient to fill a standard coin wrapper suited for that particular denomination of coins. For example when the effective height of tubular member 2 is reached by the quarters stored therein, a standard wrapper, holding 10 dollars U.S. currency will be filled to capacity when the coins are transferred thereto. The above is true for tubular member 3 wherein 5 dollars U.S. currency worth of dimes will be stored when the effective height is reached, said amount filling exactly a standard wrapper for dimes. Similarly when the effective height of tubular member 4 is reached, 2 dollars worth of nickles will be stored therein and when the effective height of tubular member 5 is reached, 50 pennies will be stored therein. These amounts correspond to the amounts needed to fill standard coin wrappers for nickles and pennies respectively.

A cover 6 is provided to prevent loss of the coins stored in the tubular members. The cover has a cover wall 11 for covering the tubular members 2–5 and a depending skirt 12. The skirt 12 is provided with securing notches 13 and 14, shown in FIG. 5, which cooperate with surfaces 15 and 16 on the tubular members 2 and 5, to releasably secure the cover 6 to the tubular members. As shown in FIGS. 1 and 4 the cover wall 11 has two openings 17 and 17' positioned to permit a coin wrapper 25 to be inserted into either an outermost tubular member such as 2 or a non-adjacent inner tubular member such as 4. In the preferred embodiment the openings 17 and 17' are substantially circular and of sufficient cross-section to permit the wrapper to be inserted into the tubular member and around the coins stored theren. By turning the cover 180° in a horizontal plane, openings 17 and 17' provide access to the other outermost tubular member 5, and the other non-adjacent inner tubular member 3. As shown in FIG. 4 the openings 17 and 17' may be covered by a closure plate 6' which is held in abutting relationship with the tubular member engaging wall 11 by frictional engagement with the inner wall of the depending skirt 12. When not in use the cover 6 may be stored in the recess 20 shown in FIG. 5. Engagement surfaces 21, shown in FIG. 3, frictionally hold the cover in the recess. Notches 22 and 23 are provided on the base 1 to aid in the removal of the cover 6 stored in the recess 20.

FIGS. 2 and 5 illustrate the clearance space 24 between the stacked plurality of coins and the inner wall of the tubular member. The clearance space 24 is of a predetermined dimension, 0.004±0.0002 inches, and is provided to permit the insertion of a standard coin wrapper 25 into the full effective height of the tubular member and around the stacked plurality of coins stored therein. A longitudinal slot 18 is provided to facilitate the insertion of a standard coin wrapper 25 which in the usual embodiment has two permanent diametrically positioned creases 26 therein caused by the flattening of the wrapper during manufacture.

To transfer coins from a tubular member to a wrapper, the closure plate 6' is removed and the cover 6 is put in place. Access to the particular tubular member through one of the openings 17, 17' of the cover is provided by properly orienting the cover on the tubular members. Access to the longitudinal slot 18 is also provided by the chosen opening.

Figure 6:
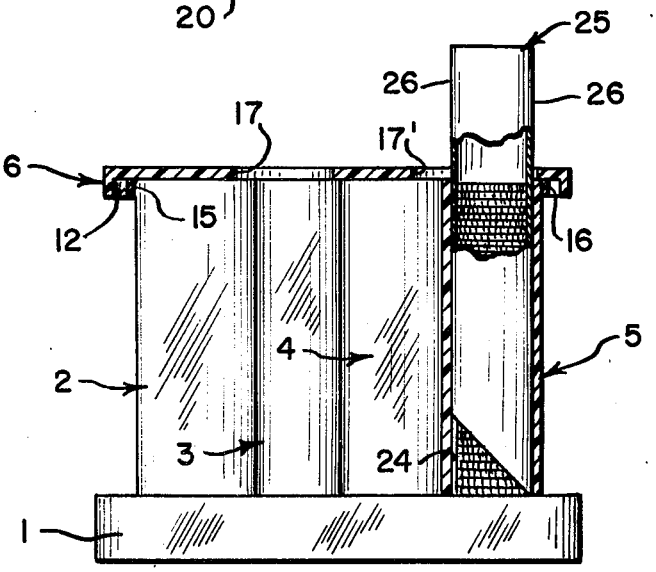
FIG. 6 is a side view, partially in cross-section, of the coin bank in use with a wrapper inserted into one of the tubular members.

FIG. 6 illustrates the coin transfer capabilities of the bank for removing the coins in the tubular member 5. The wrapper 25, as shown in FIG. 6, has one end thereof cut at an angle to the longitudinal axis of the wrapper. The tip of the wrapper as formed by this cut edge is located at the crease 26. The wrapper 25 is inserted through opening 17' into tubular member 5. The slot 18 engages a crease 26 of the wrapper 25 and guides the wrapper as it is inserted through the clearance space 24. The slot 18 further accommodates any excess portion of the wrapper which may not be of uniform size. In use the wrapper 25 is inserted fully into the tubular member 2 and around the coins stored therein. A finger is placed over the other opening 17 and the bank turned upside down. The wrapper and coins enclosed therein exit the tubular member and the wrapper is sealed. This entire operation is performed quickly and easily without any spillage of coins.

I claim:

1. An improved coin bank comprising:
(a) a base;
(b) standard creased tubular coin wrappers for the particular denomination of coins to be received therein said wrappers each having one end thereof cut at an angle to the longitudinal axis thereof with the tip of the cut edge located at the crease;
(c) a plurality of generally tubular members upstanding from one side of the base with each tubular member having,
  (1) an inner wall defining a predetermined cross-sectional area configured to receive coins having a preselected lesser cross-sectional area, and
  (2) an effective height equal to the height of a stacked plurality of coins sufficient to fill a standard coin wrapper suited for the particular denomination of coins to be received therein; and
(d) a clearance space defined by the inner wall of the tubular member and the circumference of the stack of coins stored therein, said clearance space having a width sufficient to permit the insertion of the cut end of the wrapper into the tube and around the stack of coins.

2. An improved coin bank comprising;
(a) a base;
(b) a plurality of generally tubular members upstanding from one side of the base with each tubular member having,
  (1) an inner wall defining a predetermined cross-sectional area configured to receive coins having a preselected lesser cross-sectional area,
  (2) an effective height equal to the height of a stacked plurality of coins sufficient to fill a standard coin wrapper suited for the particular denomination of coins to be received therein, and
  (3) a longitudinally slotted portion positioned in the inner wall for engaging a creased portion of the wrapper thereby guiding the wrapper as it is placed into the tube and accommodating excess portions of the wrapper as it is inserted fully into the tube and around the coins stored therein; and
(c) a clearance space defined by the inner wall of the tubular member and the circumference of the stack of coins stored therein, said clearance space having a width sufficient to permit the insertion of a wrapper into the tube and around the stack of coins.

3. The coin bank according to claim 2 wherein said tubular member clearance space has a width of 0.004±0.002 inches.

4. The coin bank according to claim 2 wherein:
(a) the tubular members are positioned in linear relationship.

5. The coin bank according to claim 4 further comprising a cover having:
(a) a tubular member engaging wall surface defining,
  (1) at least two openings positioned to permit the placing of a wrapper into either one outermost tubular member or one non-adjacent innermost tubular member; and
(b) a depending skirt having an inner surface configured to encompass the tubular members.

6. The coin bank according to claim 5 wherein:
(a) the outermost opening has a cross-sectional area sufficient to permit the insertion of a wrapper dimensioned to receive quarters; and
(b) the innermost opening has a cross-sectional area just sufficient to permit the insertion of a wrapper dimensioned to receive nickles.

7. The coin bank according to claim 6 wherein:
(a) at least one outermost tubular member has an outwardly projecting securing surface; and
(b) the inner surface of the depending skirt of said cover has at least one notch positioned to releasably engage the securing surface.

8. An improved coin bank comprising:
(a) a base;
(b) a plurality of generally tubular members arranged in linear relationship upstanding from one side of the base with each tubular member having,
  (1) an inner wall defining a predetermined cross-sectional area configured to receive coins having a preselected lesser cross-sectional area, and
  (2) an effective height equal to the height of a stacked plurality of coins sufficient to fill a standard coin wrapper suited for the particular denomination of coins to be received therein;

(c) a clearance space defined by the inner wall of the tubular member and the circumference of the stack of coins stored therein, said clearance space having a width sufficient to permit the insertion of a wrapper into the tube and around the stack of coins;

(d) a cover having:

(1) a tubular member engaging wall surface defining at least two openings positioned to permit the placing of a wrapper into either one outermost tubular member or one non-adjacent innermost tubular member, (2) a depending skirt having an inner surface configured to encompass the tubular members, (3) the outermost opening having a cross-sectional area sufficient to permit the insertion of a wrapper dimensioned to receive quarters, (4) the innermost opening having a cross-sectional area just sufficient to permit the insertion of a wrapper dimensioned to receive nickles, (5) at least one outermost tubular member having an outwardly projecting securing surface, and (6) the inner surface of the depending skirt of said cover having at least one notch positioned to releasably engage the securing surface; and (e) a base having a recess to store and hold the cover in frictional engagement.

9. A coin bank according to claim 8 wherein said recess is provided with:

(a) notch means for facilitating the removal of the cover from the base recess.

* * * * *